United States Patent [19]

Scott

[11] Patent Number: 4,506,141

[45] Date of Patent: Mar. 19, 1985

[54] REDUCED SIZE HEATING ASSEMBLY FOR AN ELECTRIC STOVE

[76] Inventor: Donald W. Scott, 530 Nightingale Ave., Miami Springs, Fla. 33166

[21] Appl. No.: 526,977

[22] Filed: Aug. 29, 1983

[51] Int. Cl.[3] ..... H05B 3/68

[52] U.S. Cl. ..... 219/463; 219/447; 219/451; 219/458; 219/467

[58] Field of Search ..... 219/447, 451, 454, 455, 219/457, 458, 459, 463, 467

[56] References Cited

U.S. PATENT DOCUMENTS

| | | | |
|---|---|---|---|
| 1,837,975 | 12/1931 | Mallett | 219/458 X |
| 2,548,183 | 4/1951 | Walton et al. | 219/463 |
| 2,727,133 | 12/1955 | Scofield | 219/463 |
| 2,733,332 | 1/1956 | Mason | 219/463 X |
| 2,751,487 | 6/1956 | Vallorani | 219/463 |
| 2,996,598 | 8/1961 | Barnes et al. | 219/458 |
| 3,042,785 | 7/1962 | Hanson | 219/463 |
| 3,133,181 | 5/1964 | Hanson | 219/458 |
| 3,284,612 | 11/1966 | Hanson | 219/447 X |
| 3,305,667 | 2/1967 | Jasionowski | 219/447 |
| 3,739,149 | 6/1973 | Fischer et al. | 219/445 |

*Primary Examiner*—Volodymyr Y. Mayewsky
*Attorney, Agent, or Firm*—John Cyril Malloy

[57] ABSTRACT

A heating assembly having a heating element including a coil portion having a substantially circular array and dimensioned to be substantially smaller than the surface aperture on the cooking surface of an electric stove in which it is mounted. An adaptor structure is secured to a drip pan and the drip pan is supported beneath the heating element and the coil portion is supported by the adaptor structure in the substantial center of the surface aperture. The heating assembly is designed to replace conventional heating assemblies sized to substantially correspond to the surface aperture of a stove cooking surface in which it is mounted. Electrical energy is thereby saved.

6 Claims, 8 Drawing Figures

REDUCED SIZE HEATING ASSEMBLY FOR AN ELECTRIC STOVE

BACKGROUND OF THE INVENTION

1. Field of the Invention

A heating assembly comprising an electric heating coil defined in a circular array and structured to be substituted for a conventional substantially larger heating element mounted on the cooking surface of an electric stove wherein the conventional heating element is substantially the same size as the surface aperture in the cooking surface in which it is mounted.

2. Description of the Prior Art

Electric stoves and ranges have been in commercial use for many years. Typically, the stove or range provides a cooking surface including a plurality of surface apertures integrally formed therein. Heating assemblies are mounted within the apertures wherein the heating assembly comprises a heating element which normally includes a coil portion having a circular array. The size of the heating coil is normally approximately the size of the surface aperture in which it is mounted. Naturally, the heating coil must be somewhat smaller to fit within the surface aperture. A drip pan is normally provided with an outstanding ring or flange wherein the bowl portion of the drip pan is disposed beneath the heating coil for the purpose of catching any spillage. The outer circular flange of the drip pan is disposed in overlying and supported relation about the periphery of the surface aperture in which the heating assembly is mounted. The heating coil itself is generally positioned in the center of the drip pan and mounted thereon in such a manner that pots, pans, etc. may be positioned directly on the heating coil so as to receive heat therefrom by direct transfer.

Generally, the various heating assemblies mounted on the cooking surface of an electric stove are of varying diameter and comprise at least two different sizes. The different sizes of the heating assemblies is provided to accommodate cooking utensils, pots, and pans of varying sizes. Naturally, it is desirable that the bottom of the pot or pan being utilized is at least as large as the heating coil on which it is supported. If the bottom of the pot or pan is significantly smaller, a tremendous amount of heat and therefore electrical energy is wasted since the portion of the heating coil extending beyond and outside of the bottom of the pan merely passes its generated heat to the surrounding air.

Generally speaking, such heat loss frequently cannot be avoided in that the heating assemblies mounted on a conventional electric stove generally are provided in only one or two sizes. Even the smallest heating element in a conventional heating assembly is too large for many commonly used cooking utensils. It is inevitable therefore that heat and energy will be wasted.

Accordingly, there is a need in the industry for a heating assembly of the type structured to be substituted for conventionally sized heating assemblies. The present invention comprises a heating coil of conventional design but of substantially smaller dimension which is adaptable for insertion into surface apertures of normal size.

SUMMARY OF THE INVENTION

The present invention is directed towards a heating assembly of the type capable of being substituted for a conventionally sized heating assembly for the purpose of reducing the amount of heat loss and energy wasted. More specifically, the heating assembly of the present invention comprises a drip pan means including a bowl portion disposed immediately beneath the heating element to be described hereinafter. The drip pan includes an annular outwardly extending flange portion having its outer peripheral edge disposed in overlaying and supported relation to the cooking surface of an electric range. The outer periphery of the annular flange is disposed substantially adjacent the periphery of a surface aperture in which a conventional heating assembly is intended to be mounted.

Adaptor means of the present invention comprises an extended length of the annular flange extending from its supported, overlying engagement relative to the periphery of the surface aperture to a central aperture which in this embodiment defines the open end or top of the drip pan.

A heating element in the form of a coil portion is defined by a circular array and has a diameter substantially less than the surface aperture in which the heaing assembly is mounted. This of course differs from the much larger conventional heating coil which generally has a diameter only slightly less than the surface aperture in which it is mounted.

Accordingly, the extended flange dimension serves as an adaptor for substantially centering the heating coil within the central aperture of the drip pan as well as the surface aperture in which a conventional heating assembly is normally mounted.

Another embodiment of the present invention comprises a drip pan means which has an annular flange of substantially small dimension wherein the overall drip pan substantially corrsponds to the size of the surface aperture in the cooking surface of a stove in which it is mounted. For this larger size drip pan, the other embodiment of the present invention comprises the provision of an adaptor means disposed on the interior of the drip pan and supported on an annular ledge extending inwardly toward the center. The adaptor means comprises a ring element having a substantially annular configuration and defining a central aperture on the interior of the annularly configured ring element.

Further, a heating element in the form of a reduced diameter coil portion is disposed and mounted on the adaptor ring in the substantial center thereof. A mounting bracket supporting the heating coil extends outwardly radially to a point where it rests on an inwardly extending flange integrally formed on the ring element of the adaptor means.

Another feature of the present invention comprises opposite ends of the heating coil disposed in spaced apart parallel relation to one another and being of substantially equal length. However, the length of each of the free ends of the coil portion is substantially extended such that each end is attached to a terminal contact. These terminal contacts plug into an electrical socket in the conventional fashion. Since the electrical socket is normally fixedly secured and positioned to receive a terminal contact, a coil portion of reduced diameter requires that the opposite ends of the heating coil have an extended longitudinal diameter so as to position the heating coil in its centered position within the central aperture and supported on the ring element of the adaptor means.

Accordingly, through use of either the above two embodiments, a heating assembly utilizing a heating coil of relatively small diameter may be substituted for a conventional heating assembly incorporating a heating coil having a diameter substantially equal to but somewhat less than the surface aperture in which it is mounted. This utilization of a smaller heating coil reduces heat loss and therefore saves energy since the majority of cooking utensils utilized will cover the entire heating coil when supported thereon for cooking or the like.

BRIEF DESCRIPTION OF THE DRAWINGS

In order to obtain a better understanding of the nature of the present invention, reference is hereby made to the following detailed drawings, in which.

Similar reference characters refer to similar parts throughout the several views of the drawings.

DETAILED DESCRIPTION OF THE PREFERRED EMBODIMENT

Figure 1:
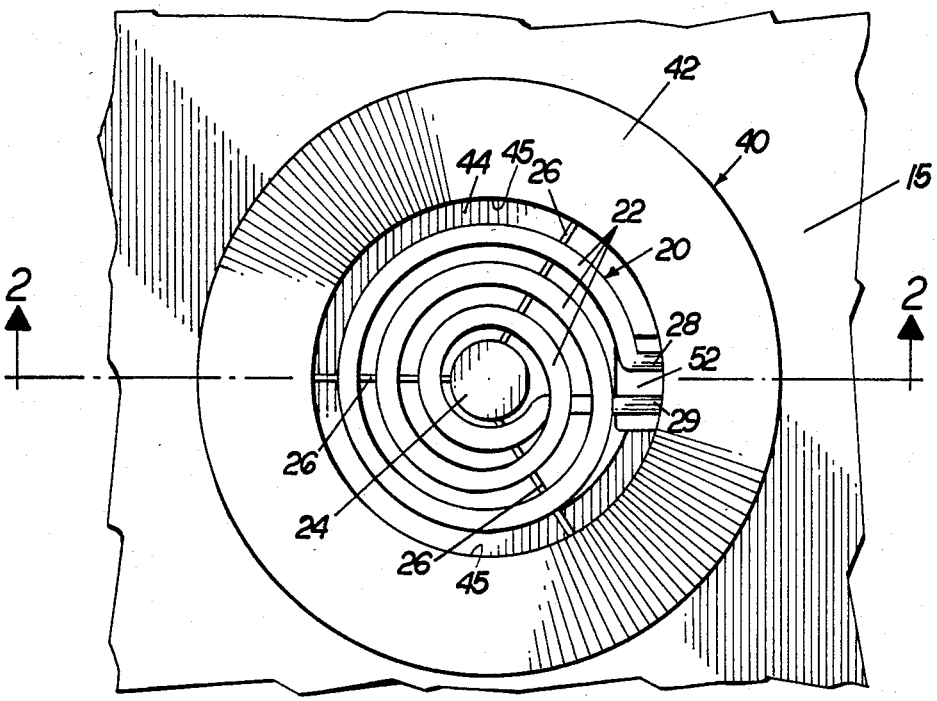
FIG. 1 is a top plan view of one embodiment of the subject heating assembly mounted on a cooking surface of an electric range.

One embodiment of the present invention is shown in FIGS. 1 through 4 wherein the heating assembly generally indicated as 40 is mounted on a cooking surface 15 of an electric range or stove. Further, at least one surface aperture 18 is formed in the cooking surface 15 such that the heating assembly 40 is mounted substantially therein.

The heating assembly 40 comprises a drip pan means 41 including an annular flange 42 having its outer peripheral edge as at 46 resting on the cooking surface 15 immediately adjacent the periphery of the surface aperture 18. Accordingly, the heating assembly is supported therein. The drip pan means 41 further comprises a bowl portion 48 disposed immediately beneath the heating element generally indicated as 20 in order to catch any spillage from cooking utensils or the like resting on the heating element 20. An overflow aperture 50 is integrally formed in the bowl portion 48 as best shown in FIG. 2. The heating element 20 comprises a coil portion 22 having a substantially circular array (FIG. 1) wherein a mounting bracket 26 has a plurality of outwardly extending legs the end of each being mounted on an inwardly directed ledge or flange 44 also integrally formed on the drip pan means between the annular flange 42 and the bowl portion 48. Further structural features of the drip pan include an aperture 52 formed in the wall of the bowl portion 48 to allow exiting of the free ends 28 and 29 of the coil portion 22. Exiting of the free ends is for the purpose of connecting with terminal contacts 30 for connection within sockets 31 which in turn are interconnected to an electrical power supply by conductor 32.

An important feature of the present embodiment is the provision of an adaptor means which is in the form of an extended flange length of the annular flange 42. This allows the flange 42 to extend a greater distance from its point of contact at 46 with surface 15 inwardly towards the center so as to adequately position both the bowl portion 48 and the heating element 20. Accordingly, the present invention by virtue of this embodiment contemplates the use of a heating element 20 in the form of a coil portion 22 having a circular array with a diameter or overall dimension substantially smaller than the normal heating element intended to be positioned within surface aperture 18. Normally, a conventional heating element would have a diameter substantially corresponding to the diameter or overall dimension of the surface aperture 18 but actually being somewhat less. The conventional heating coil or heating element could therefore substantially fit on the interior of the surface aperture 18. By virtue of the present invention, as particularly set forth in FIGS. 1 through 4, the adaptor means including the annular flange of extended length serves to position the bowl portion 48 of the drip pan means beneath the substantial center of the surface aperture 18 and the inner periphery of flange 42 defines a central aperture 45 in which the coil portion 22 or heating element 20 is centered. Therefore, the heating element 20, being substantially smaller than the surface aperture 18, will be totally covered by conventional heating utensils such as pots and pans, etc. and therefore no energy or heat will be lost. Other structural features of the embodiments of FIGS. 1 through 4 is the provision of spacer elements 60 integrally secured to the outer surface of the drip pan means and being in spaced apart relation to one another. The spacer elements 60 are positioned to substantially correspond to and abut the periphery of the surface aperture 18 in order to insure centering of the drip pan means within the surface aperture 18 and therefore proper centering of the heating element 20.

With regard to the embodiments of FIGS. 5 through 8, the heating assembly therein disclosed comprises a drip pan means 80 having a bowl portion 84 and an overflow aperture 88 centered below the heating element 20 and positioned in supported relation within the surface aperture 18. The drip pan means 80 includes an annular flange 82 of substantially conventional dimension which does overhang and engage the cooking surface 15 at a position 17 immediately adjacent the surface aperture 18. Accordingly, the overlapping support of the annular flange 82 serves to center and support the drip pan means 80 within the surface aperture 18.

An adapter means generally indicated as 70 comprises a ring element 72 having a central aperture 78 and a surrounding inwardly directed flange 74 disposed about the periphery of the central aperture 78. The heating element 20 similarly includes the coil portion 22 having a substantially circular array and mounting brackets 26 with outwardly projecting fingers, the end of which are supported on the inwardly directed peripheral flange 74. The ring element 72 further comprises a downwardly extending flange 75 disposed to be mounted on and supported by the ledge 86 integrally formed between bowl portion 84 and the annular flange element 82. The heating element 20 and more specifically the coil portion 22 is of a specifically reduced dimension mounted on adaptor means 70 which is in turn supported by the drip pan means 80. The coil portion 22 is thereby centered in the surface aperture 18 and further centered in the central aperture 78 by virtue of the adaptor means 70 being positioned on the interior of the drip pan means 80. Therefore, adaptor means 70 comprises the ring element 72 being disposed and structured to define an extended flange length of annular flange 82 and also define the peripheral boundaries of a reduced diameter central aperture 78 dimensioned in substantial conformance with coil portion 22. Accordingly, the coil portion having a substantially reduced diameter is mounted within the much larger surface aperture 18 formed in the cooking surface 15. This structure allows a smaller heating element 20 to be used in a conventionally or normally sized surface aperture 18 of cooking surface 15. Heat is not wasted to the atmosphere since the cooking utensils, including pots and pans, normally covers the entire coil portion. Energy is thereby saved.

Figure 2:
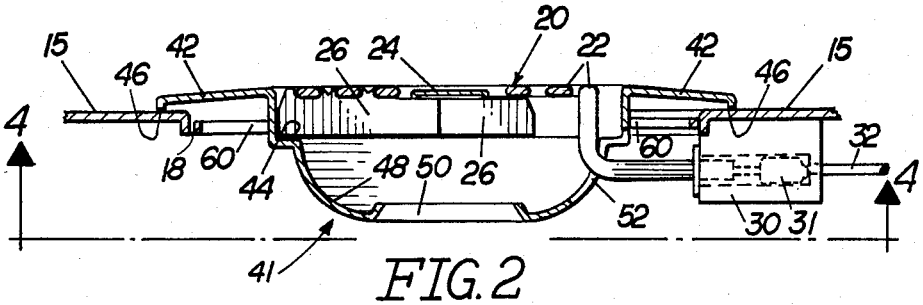
FIG. 2 is a sectional view along line 2—2 of FIG. 1.
Figure 3:
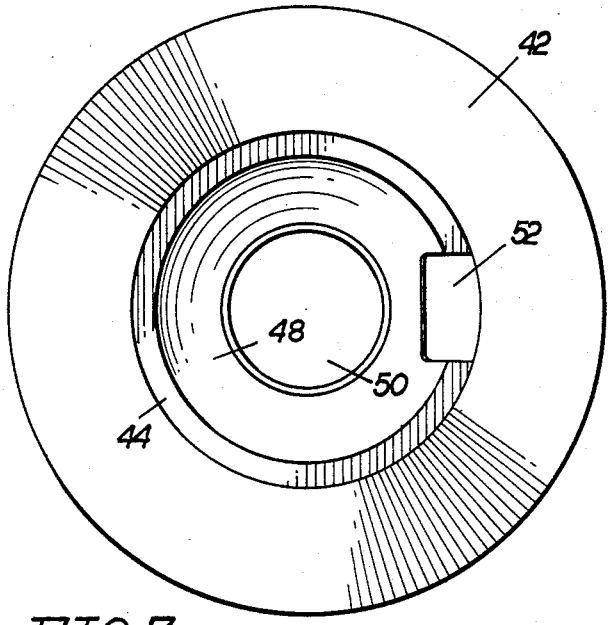
FIG. 3 is a top plan detailed view of a drip pan structure of the present invention.
Figure 4:
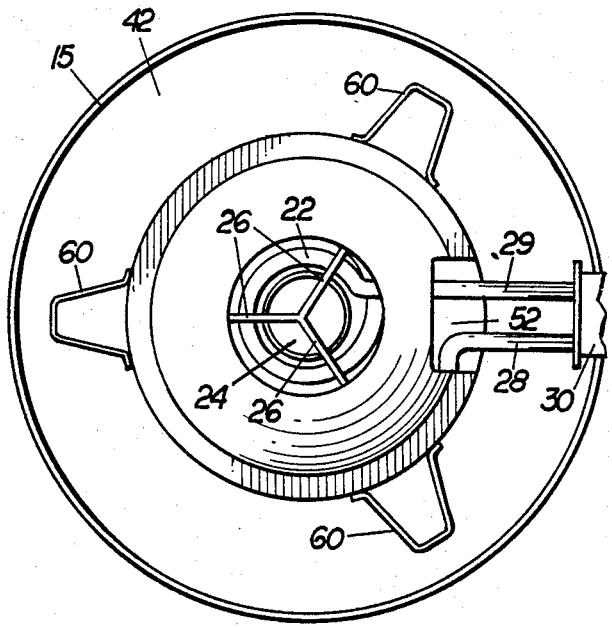
FIG. 4 is a bottom view along line 4—4 of FIG. 2.
Figure 5:
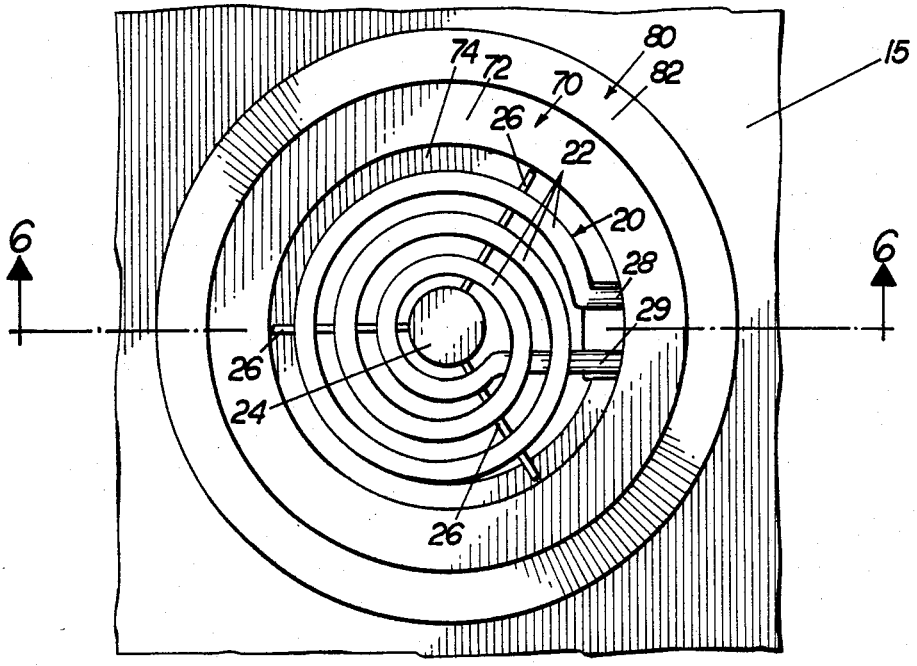
FIG. 5 is a top plan view of yet another embodiment of the heating assembly of the present invention.
Figure 6:
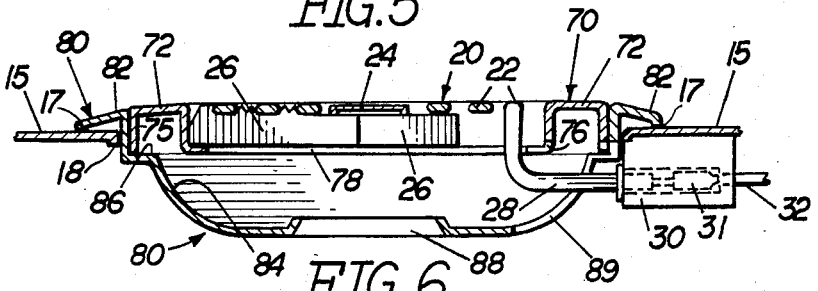
FIG. 6 is a sectional view along line 6—6 of FIG. 5.
Figure 7:
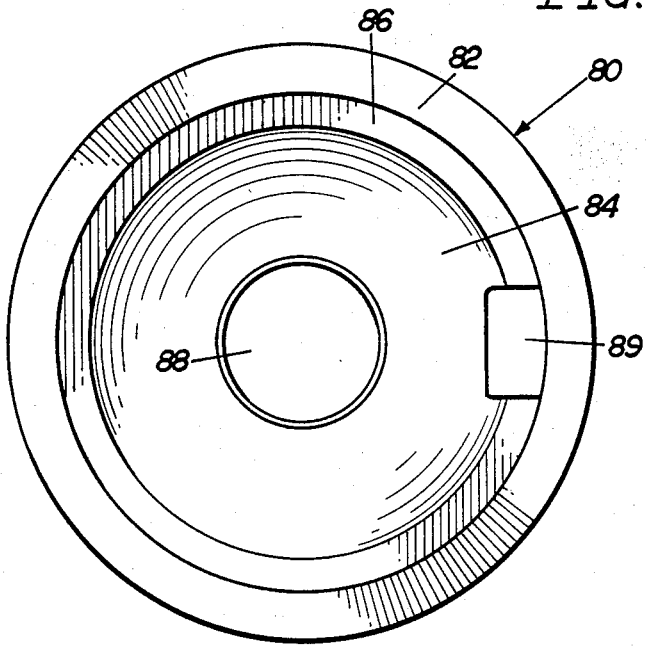
FIG. 7 is a top plan view in detail of a drip pan structure of the present invention.
Figure 8:
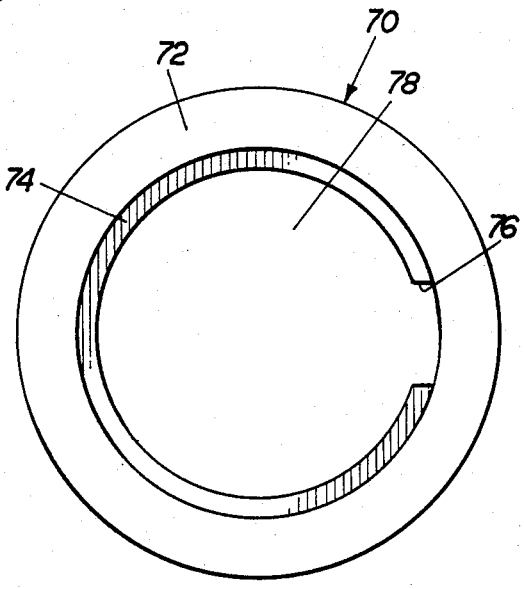
FIG. 8 is a top plan view in detail of an adaptor structure of the present invention shown in detail.

Further structural features include a center disk 24 disposed in each of the embodiments of FIGS. 1 and 5. A central overflow aperture 88 is integrally formed in the bowl portion 84 of the drip pan and an additional aperture 89 is provided for the exiting of the ends 28 and 29 of the coil portion 22. The coil portion similarly is connected to contact terminals 30 mounted within socket 31 which in turn is connected to electrical supply through conductor 32.

Another structural feature of the present invention is the extended dimension of the ends 28 and 29 from the point where they leave the circular array of coil portion 22 and they enter the socket 31. Depending upon the the size of the surface apertue 18, 10, the contact terminals as at 30 are spaced a predetermined standard distance from the center thereof. The extended dimension of at least one of the ends 28 and 29 and more specifically the shortest end 28 has a longitudinal dimension equivalent to at least 30% of the radius of the surface aperture 18 in which the heating coil 22 is mounted. Depending upon the specific size of coil 22 such end 28 would be extended in length up to at least 50% of the radius of surface aperture 18. The extended dimension of the free ends 28 and 29 are also provided to establish disposition of the coil portion 22 in the substantial center of the surface aperture 18 and central aperture 78.

What is claimed is:

1. A heating assembly primarily designed to mount and undersized heating coil in a standard sized surface aperture and cooking surface of an electric stove, said assembly comprising:

(a) an adaptor ring adapted for use in combination with a drip pan mounted within the surface aperture, the drip pan including a bowl and a flange portion respectively disposed below and above the cooking surface in which the surface aperture is formed, said flange portion connected to the bowl and disposed in surrounding outwardly extending relation to an upper portion of the bowl, (b) said adaptor ring and the drip pan being formed from a heat resistant material, (c) the heating element mounted on said adaptor ring and comprising an undersized heating coil centered within said adaptor ring and including a diameter having a dimension a predetermined amount less than the diameter of the surface aperture in which said heating coil is positioned, (d) said adaptor ring removably mounted on the drip pan means and including a peripheral flange disposed adjacent to and substantially defining an extension of the flange portion, said peripheral flange further disposed in surrounding, spaced apart and adjacent relation to an outer periphery of said undersized heating coil, (e) said peripheral flange structured to include a transverse dimension sufficient to extend from the flange portion to said outer periphery of said undersized heating coil and substantially overlaying collectively with the flange portion, a majority of the distance between said outer periphery and a correspondingly disposed periphery of the surface aperture, (f) said undersized heating coil comprising two free ends integrally secured to opposite ends of said heating coil and each including correspondingly disposed extremities structured for interconnection to an electrical power supply, said free ends being longitudinally dimensioned for centering of said heating coil within said adaptor ring, (g) at least one of said free ends having an extended longitudinal dimension being at least 30% of the radius of the surface aperture, whereby said undersized heating coil is substituted for a conventionally sized heating coil of a diameter substantially corresponding to the size of the surface aperture.

2. A heating assembly as in claim 1 wherein said two free ends are disposed and structured to define a longer free end extending from a first opposite end of said undersized heating coil disposed closest to the center thereof and a shorter free end extending from a second opposite end of said undersized heating coil disposed about said outer periphery thereof; said shorter free end having an extended longitudinal dimension being at least 30% to 50% of the radius of the surface aperture.

3. A heating assembly as in claim 2 wherein said shorter free end has a longitudinal dimension being at least 50% of the radius of the surface aperture.

4. A heating assembly as in claim 1 wherein said adaptor ring is disposed in surrounding relation to and at least partially defining a central aperture in which said undersized heating coil is disposed, said adaptor ring further comprising an inwardly directed flange spaced downwardly from said peripheral flange and further disposed for removable supporting of said undersized heating coil thereon.

5. A heating assembly as in claim 1 wherein said undersized heating coil has a diameter of predetermined dimension of at least between one-fourth and one-third less than the diameter of the surface aperture.

6. A heating assembly as in claim 1 wherein said undersized heating coil has a diameter dimensioned to be at least one-third less than the diameter of said surface aperture.

* * * * *